US006587191B2

(12) United States Patent
Greenfield et al.

(10) Patent No.: US 6,587,191 B2
(45) Date of Patent: Jul. 1, 2003

(54) IN-ACTION BORESIGHT

(75) Inventors: Jonathan Greenfield, Haifa (IS); David Zarchi, Kiryat Tivon (IS); Hai Pedut, Haifa (IS); Ram Lebber, Mosgov (IS)

(73) Assignee: Rafael-Armament Development Authority Ltd., Haifa (IL)

( * ) Notice: Subject to any disclaimer, the term of this patent is extended or adjusted under 35 U.S.C. 154(b) by 0 days.

(21) Appl. No.: 09/746,002

(22) Filed: Dec. 26, 2000

(65) Prior Publication Data

US 2002/0026740 A1 Mar. 7, 2002

(30) Foreign Application Priority Data

Dec. 30, 1999 (IS) ..... 133835

(51) Int. Cl.[7] ..... G01B 11/26; G01B 21/02; G01B 7/00

(52) U.S. Cl. ..... 356/139.07; 244/3.16; 244/3.13; 250/203.2; 356/141.1

(58) Field of Search ..... 244/3.13, 3.16; 356/139.07, 141.1; 89/41.06, 41.05; 250/203.2

(56) References Cited

U.S. PATENT DOCUMENTS 4,274,735 A * 6/1981 Tamura et al.
5,007,736 A * 4/1991 Daniel et al.
5,456,157 A * 10/1995 Lougheed et al. ..... 89/134
5,786,889 A * 7/1998 Pope et al. ..... 356/141.1
5,838,014 A 11/1998 Cabib et al.
6,021,975 A * 2/2000 Livingston ..... 244/3.13
6,331,887 B1 * 12/2001 Shiraishi et al. ..... 356/3.03

FOREIGN PATENT DOCUMENTS

| | | |
|---|---|---|
| EP | 0735341 A1 | 10/1996 |
| EP | 0992759 A1 | 4/2000 |
| GB | 2165957 | 10/1984 |

* cited by examiner

*Primary Examiner*—Stephen C. Buczinski
(74) *Attorney, Agent, or Firm*—Mark M. Friedman

(57) ABSTRACT

A method for boresighting of a designation system, including a tracker responsive to a detector with reference to an indicator, including the step of directing a beam of light at a target, using a light source, so that the beam of light is reflected from a spot on the target while a temperature of the spot remains substantially constant. The method further includes focusing at least part of the reflected light as an image on the detector and determining a misalignment of the indicator and the image.

6 Claims, 4 Drawing Sheets

IN-ACTION BORESIGHT

FIELD AND BACKGROUND OF THE INVENTION

The present invention relates to an in-action boresight for laser designation systems.

Modem weapon systems, which employ laser-guided bombs and missiles, require highly accurate alignment of their designation systems in order to achieve a high probability of target acquisition. Traditional methods of achieving this involve ground-based pre-flight calibration of detectors with their corresponding designator, commonly known as boresighting. Ground-based boresight systems are typically robust, heavy and bulky. After ground-based boresighting has been conducted, however, misalignments can develop between the detectors and designators due to environmental conditions, i.e. mechanical and thermal loads including vibrations, shocks and temperature variation. These misalignments can significantly degrade the performance of the designation systems.

To overcome the misalignment problem, in-flight boresight systems have been developed which can be operated a short time prior to weapon operation. Thus, the misalignments that could normally have occurred from boresighting to designator operation are significantly reduced. These systems, however, are typically made up of a large number of optical components which have the potential for introducing further thermo-optical errors and are prone to in-flight misalignment. Furthermore, current methods rely on local heating of specific types of targets, such as ceramics, using laser radiation in order to generate hot-spots, which are then detected by sensor systems. These methods have number of drawbacks, which are discussed below.

As an example, consider FIG. 1 which shows a target 500 where a laser beam (not shown) is incident on the target surface 502, thereby generating laser spot 504. Heat is conducted by target 500 and this results in a temperature distribution on target surface 502. Concentric closed loops 506, 508 and 510 are isotherms (lines of constant temperature on target surface 502) and indicate a typical temperature distribution caused by laser spot 504. The temperature is highest at laser spot 504 and decreases with radial distance. It will be readily appreciated that isotherms 506, 508 and 510 are in general non-circular and non-symmetric around laser spot 504. This is due to asymmetric conduction within the material that makes up target 500. Thus, a sensor (not shown) that is operative to detect the local heating which results from laser spot 504, will incorrectly detect a center 512 for example, instead of the correct center 501 of laser spot 504.

The above description illustrates a number of major drawbacks of current boresight systems. Firstly, a period of time, which is non-negligible when compared with the time required for boresighting, is required to heat target surface 502 at the center 501 of laser spot 504 to a temperature that allows sensor detection (typically 25 degrees Celsius above target surface temperature). Secondly, a specific target type is required, such as certain ceramics, which has the particular conductive properties required for generating thermally detectable laser spot. Thirdly, asymmetric conduction on the target surface, as depicted graphically in FIG. 1, can result in incorrect detection of the laser spot center, thereby degrading the accuracy of the system. Fourthly, in order to effect thermal detection, a large number of additional optical components must be added to the designation system. As mentioned above, these additional optical components increase the probability of in-flight misalignment and reduce accuracy.

There is therefore a need for an accurate and rapid in-action boresight which has a minimum of additional optical components. The system should not rely on laser heating of specific targets, but should rather detect an optical laser spot. This would both increase the system accuracy and eliminate the time required for heating a target, thereby reducing the overall boresighting time. Furthermore, the system should not be limited to a specific target type, but should allow boresighting on a variety of targets.

SUMMARY OF THE INVENTION

The present invention is a method for in-action boresighting of designation systems.

According to the teachings of the present invention there is provided, a method for boresighting of a designation system, including a tracker responsive to a detector with reference to an indicator, comprising the steps of (a) directing a beam of light at a target, using a light source, so that the beam of light is reflected from a spot on the target while the spot temperature remains substantially constant; (b) focusing at least part of the reflected light as an image on the detector; and (c) determining a misalignment of the indicator and image.

There is furthermore provided, in a boresighting system for aligning an indicator with an image of a spot on a target, a method of displaying the alignment, comprising the steps of providing a video monitor; and displaying a representation of the indicator together with a representation of the image on the video monitor.

BRIEF DESCRIPTION OF THE DRAWINGS

The invention is herein described, by way of example only, with reference to the accompanying drawings, wherein.

DESCRIPTION OF THE PREFERRED EMBODIMENTS

The principles and operation of the in-action boresight according to the present invention may be better understood with reference to the drawings and the accompanying description.

Figure 1:
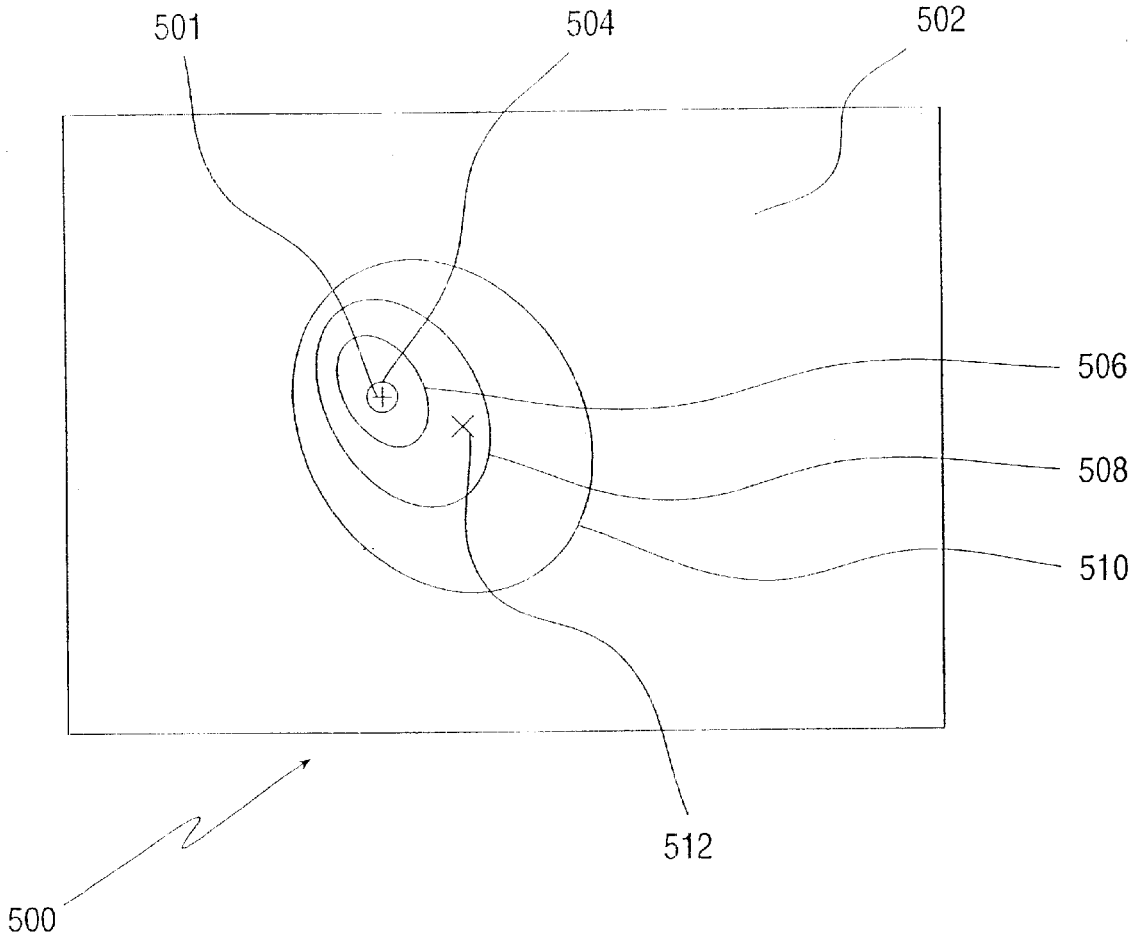
FIG.1 (Prior art)
FIG. 1 is a schematic depiction of a target with a laser spot incident on its surface (prior art)
Figure 2:
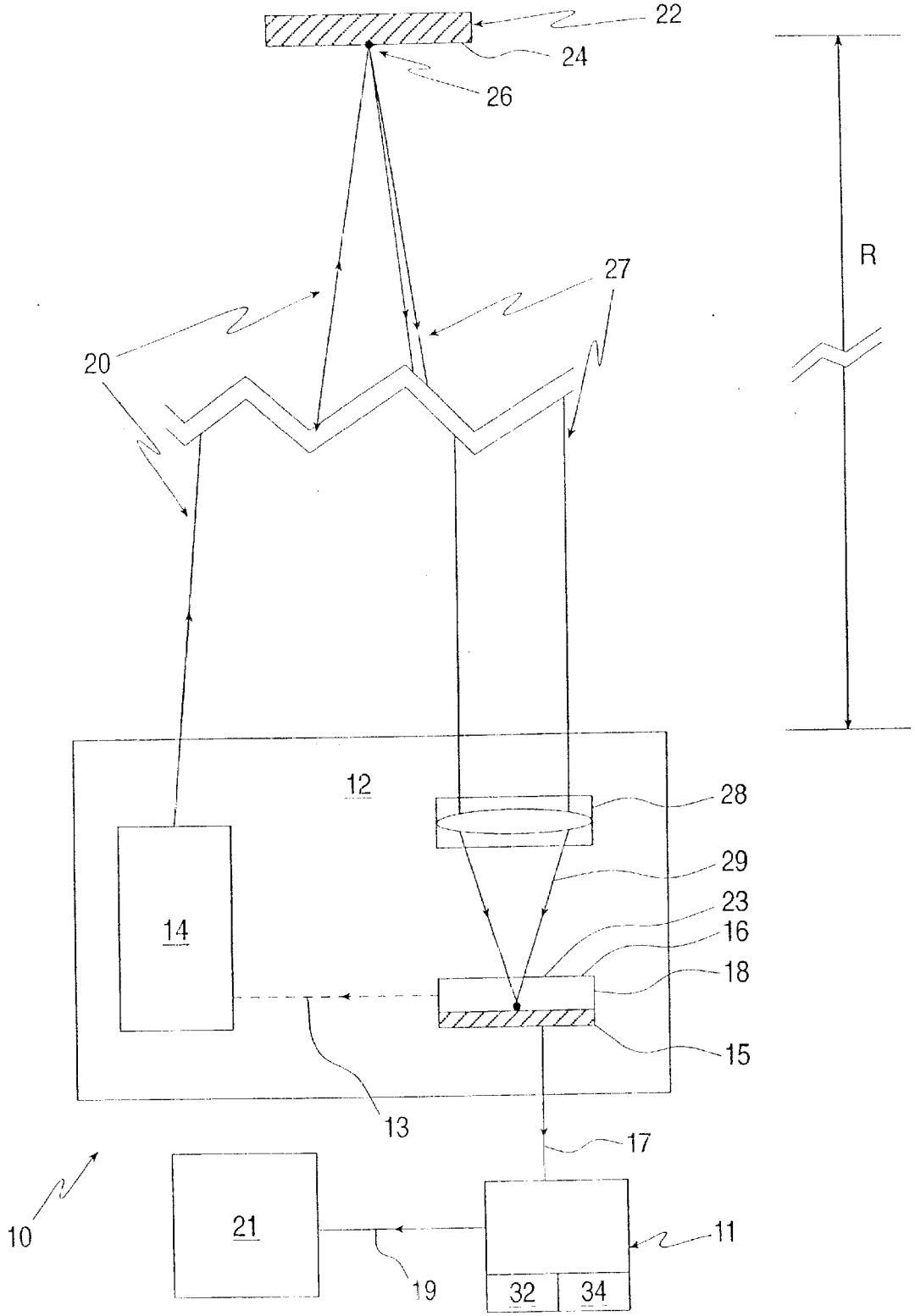
FIG. 2 is a schematic depiction of a designation system constructed and operative according to the teachings of the present invention.

Referring again to the drawings, FIG. 2 shows the designation system 10, which is made up of a laser designator 14, receiving optics 28 and a detector 16, which are all mounted on a rigid gimbaled base 12. Rigid gimbaled base 12 is required for the mounting of all components so as to minimize the possibility of misalignment between the various components. A synchronization line 13 synchronizes the operation between laser designator 14 and detector 16. A tracker line 17 connects detector 16 to a tracker 11.

Preferably, tracker 11 is connected to a video monitor 21 via a video line 19. Designation system 10 is positioned at a distance R from a target 22, where R is referred to as the range-to-target. Target 22 is usually remote, relative to designation system 10, such that R is typically greater than 1500 meters.

In brief, the objective of boresighting is to align an indicator, such as a cross-hair (not shown), encoded in tracker 11, with a laser spot image (not shown). After boresighting is complete, typically a cross-hair indicates the location of a laser spot center on target 22. The indicator and laser spot image may be simultaneously represented as a video image. In a preferred embodiment of the present invention, a cross-hair and laser spot image are displayed simultaneously on video monitor 21. Boresighting of designation system 10 is achieved according to four main stages, namely: stage I—designation; stage II—laser-spot detection; stage III—signal processing; and stage IV—misalignment correction. These stages must be carried out sequentially, starting with stage I and ending with stage IV. The features of each of the stages, as well as their interrelation, are described in detail below.

In Stage I, the purpose of laser designator 14 is designating, i.e. creating a laser spot 26 on target 22. As a preferred embodiment, laser spot 26 is formed on the surface 24 of target 22. If target 22 is a diffuse body, such as a cloud, water droplets or even pollution, laser spot 26 can also be formed on particles within target 22. Laser designator 14 is typically a pulsed infra-red or visible-light laser which can be pulsed at a wide range of frequencies (alternatively pulses per second, PPS). Laser designator 14 is activated in external triggering mode by detector 16 via synchronization line 13, thereby producing laser beam 20. Laser beam 20 is directed towards target 22 and is incident on the target surface 24. Incident laser beam 20 creates an optical laser spot 26 on target surface 24, which is reflected from surface 24 and produces a reflected beam which is referred to herein as the laser echo 27. Optical laser spot 26 is "optical" in the sense that laser beam 20 is merely reflected from surface 24 and does not appreciably change the temperature at the location of target 22 where it is incident. Thus, laser echo 27 can include visible, infra-red or near infra-red wavelengths. In general, target surface 24 may be composed of any partially reflective substance: even certain atmospheric conditions or clouds constitute suitably reflective surfaces. It should be emphasized that the purpose of laser beam 20 is not to cause local heating of target surface 24, but rather to generate an optical laser spot 26.

In stage II, target detection, laser echo 27 from optical laser spot 26 is incident on receiving optics 28. Laser echo 27 is focused by means of receiving optics 28 resulting in focused beam 29 which is incident on detector 16. To effect detection of laser echo 27, detector 16 incorporates a sensor 15 of some kind. Typical examples of sensor 15 include Forward-Looking Infra-Red (FLIR) sensors or Charge-Coupled Device (CCD) such as GICCD and EBCCD sensors, for example. Detector 16 triggers and synchronizes laser designator 14. This means that a laser pulse is initiated by detector 16 and then the detector integration time is set to a time-frame window on which laser echo 27 is expected to be received. This window corresponds to any reasonable range to target R. A range gate is employed to eliminate spurious light signals from short ranges (typically less than 1500 meters). Thus parallax errors, which could cause misalignment, are eliminated. The focusing of beam 29, which is incident on detector 16, results in the formation of a laser spot image 23 on the surface 18 of sensor 15. Background light (not shown), from the target for example, is also incident on sensor surface 18. All light signals incident on sensor surface 18 are received by detector 16 and transferred via tracker line 17 to tracker 11.

Part of the function of tracker 11 is to distinguish between the coordinates of laser spot image 23 and background light that is incident on sensor surface 18. (The preferred method employed to achieve this is discussed later in detail.) Coordinates of the center (not shown) of laser spot image 23 and background light, which are stored as successive video frames in tracker 11, can be converted into a video image 40 (see FIG. 3) and transferred via video line 19 to video monitor 21 where these coordinates are visually displayed. It is pointed out that video image 40 can be stored or displayed in a variety of virtual or physical forms, such as random-access memory, magnetic tape, etc.

Figure 3:
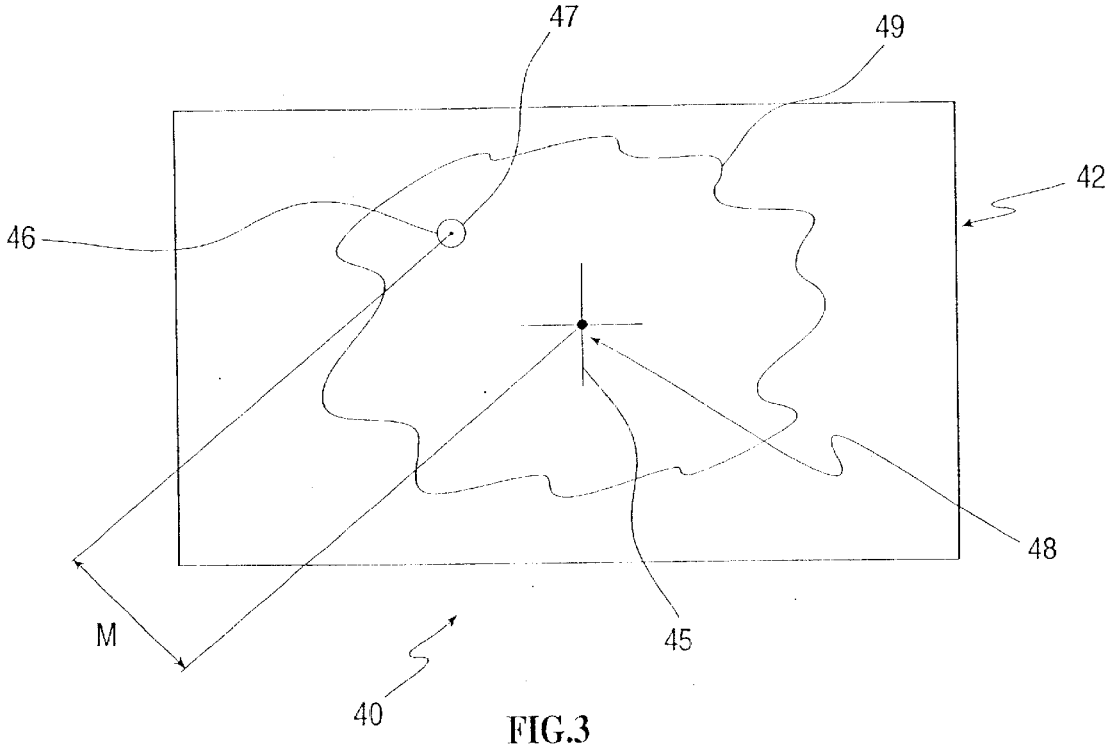
FIG. 3 is a schematic depiction of a video image before boresighting.

FIG. 3 is a schematic depiction of a video image 40, showing a laser spot image 46, background light 49 and a cross-hair 45. Laser spot image 46 is located with its center at a spot image center 47 and cross-hair 45 is located with its center at a cross-hair center 48. Cross-hair 45 may be synthetically generated on video image 40 with its coordinates encoded in tracker 11 (see FIG. 2). Thus, video image 40 simultaneously represents laser spot image 46, cross-hair 45 and background light 49. In general, laser spot image 46 and cross-hair 45 are not initially coincidental (if laser spot image 46 and cross-hair 45 are coincidental, then the system is boresighted). The misalignment, between spot image center 47 and cross-hair center 48 is designated M in the figure.

The primary purpose of stage III, Signal Processing, is to determine misalignment M. This function is performed by tracker 11, which computes the misalignment M between spot image center 47 and cross-hair center 48. The signal-to-noise-ratio (SNR) of laser spot image 46 is proportional to the reflectivity of target surface 24 and inversely proportional to the range-to-target R. Thus, when a combination of low target reflectivity and range-to-target R results in a low SNR, the tracker 11 must integrate several (e.g. 20 to 40) video image frames in order to accurately detect spot image center 47. A preferred method for achieving this is discussed below.

Coordinates of laser spot image 23 and cross-hair 45, which are encoded in tracker 11, can be transferred via video line 19 to video monitor 21, for visual display, much like that shown in FIG. 3. Cross-hair 45 may be synthetically generated on video display 44 with its coordinates encoded in tracker 11 (see FIG. 2). In general, a video display image processed by tracker 11 contains laser spot image 46 as well as background light 49.

In general, a video frame processed by tracker 11 contains laser spot image 46 as well as background light 49. Laser designator 14 is limited in that it can only operate at a maximum frequency of approximately 15 pulses per second (PPS). Thus, a video format is selected which is some multiple of laser designator 14 operating frequency. For example, in order to detect only laser spot image 46, laser designator 14 is triggered at one half of the video frame rate of video monitor 21. Thus, if the video frame rate is 30 Hz, such as in RS170 format, laser designator 14 is triggered at 15 pulses per second (PPS) which is half the RS170 format frame-rate. Alternatively, if the video frame rate is 25 Hz, such as in CCIR format, laser designator 14 is triggered at 12.5 PPS. This results in the reception of a laser spot image on every even video frame and an image with no laser spot on every odd video frame, or vice versa. Tracker 11 then integrates the even frames in a first memory bank 32 and the odd frames in a second memory bank 34. In this manner, tracker 11 processes laser spot image 46 in first memory bank 32 and simply discards background light 49, from second memory bank 34, simultaneously.

Due to the short integration time, only laser spot image 46 is stored in first memory bank 32, because background light 49 data does not exceed inherent tracker 11 noise levels. In this manner tracker 11 accurately determines spot image center 47. At this point, tracker 11 contains the coordinates of both spot image center 47 and cross-hair center 48. Thus, tracker 11 computes a misalignment M between spot image center 47 and cross-hair center 48.

In stage IV, Misalignment Correction, boresighting is completed in tracker 11, by aligning spot image center 47 and cross-hair center 48. For visual display, it is desirable to keep cross-hair 45 as close as possible to the center of video display 44. Two preferred methods are employed to achieve this. The first method is described with respect to FIG. 4A and the second method is described with respect to FIG. 4B.

Figure 4A:
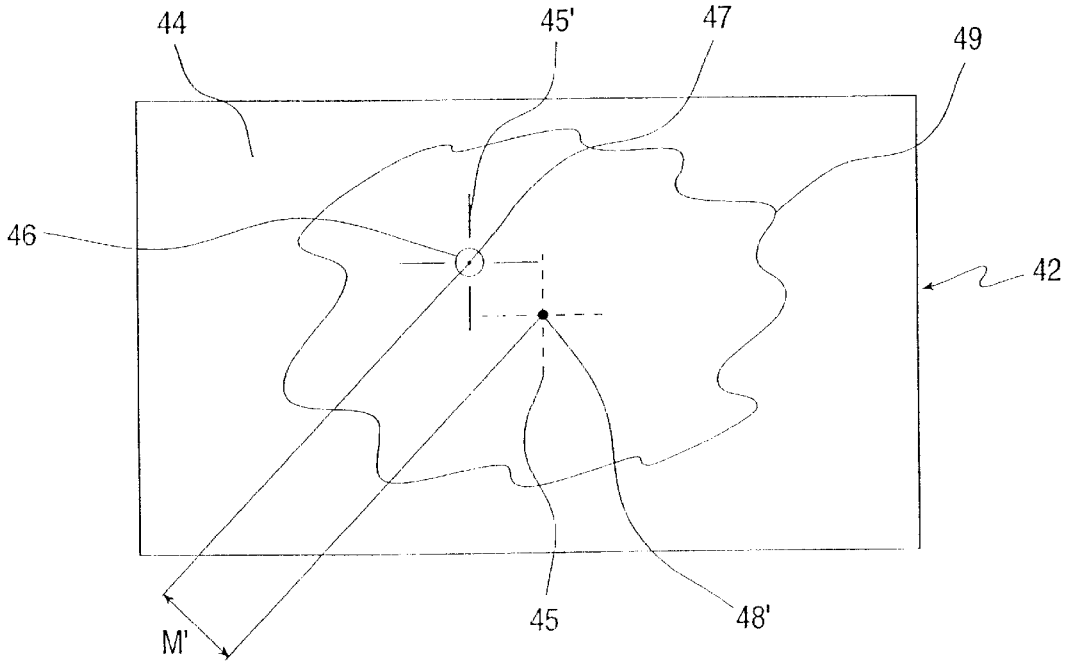
FIG. 4A is a schematic depiction of a video display after boresighting by moving a cross-hair.

The first method is often employed when spot image center 47 of laser spot image 46 is sufficiently close to the center of video display 44 as depicted in FIG. 4A. In this instance, boresighting is achieved by moving cross-hair 45 from a first cross-hair center 48' to a second cross-hair center that is coincidental with first spot image center 47, which corresponds to misalignment M'. Thus, after boresighting, the center of cross-hair 45' is coincidental with first spot image center 47 and is close to the center of video display 44.

Figure 4B:
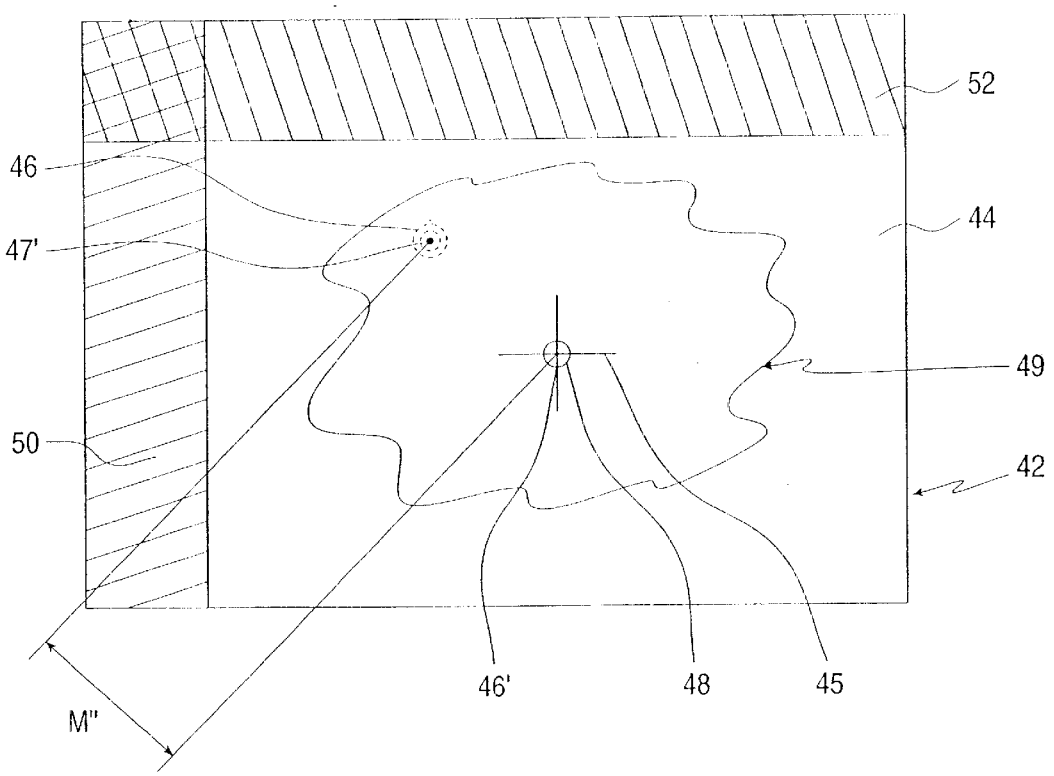
FIG. 4B is a schematic depiction of a video display after boresighting by moving displayed pixels.

The second method is often employed when a first spot image center 47' of laser spot image 46 is not sufficiently close to the center of video display 44 as depicted in FIG. 4B. Here, the misalignment between first spot image center 47' and cross-hair center 48 is M". In this instance, boresighting is achieved by moving the entire video display 44, excluding cross-hair 45, to a new matrix of pixels. In general, the display of the correction of misalignment M" is achieved by utilizing vertical columns of synthetic pixels 50 on the side of video display 44 and horizontal rows of synthetic pixels 52 at the top (or bottom) of video display 44. For example, if the display is moved towards the left-hand side such that vertical columns of synthetic pixels 50 are added to video display 44, then corresponding columns of pixels (not shown) on the right-hand side of video display 44 are removed from video display 44. Thus video display 44 maintains its original size. In this manner the entire video display 44 is moved laterally and longitudinally such that a second spot image center of laser spot image 46' is coincidental with cross-hair center 48, and is thus close to the center of video display 44.

It will be appreciated that the above invention fulfills the need for an accurate and rapid in-action boresight which has a minimum of additional optical components. Boresighting is based on the detection of an optical laser spot and, as such, eliminates the need for targets heating. Thus accuracy is increased and the additional time required for heating a target is eliminated. Furthermore, boresighting can be performed on a variety of targets, thereby increasing flexibility and versatility.

It will be further appreciated that the above descriptions are intended only to serve as examples, and that many other embodiments are possible within the spirit and the scope of the present invention.

What is claimed is:

1. A method for boresighting of a designation system, including a tracker responsive to a detector, comprising the steps of:

(a) directing a beam of light at a target, using a light source, so that said beam of light is reflected from a spot on said target while a temperature of said target at said spot remains substantially constant and unchanged from what said temperature was prior to said directing of said beam of light at said target;

(b) focusing at least part of said reflected light as an image on the detector; and (c) determining a misalignment of an indicator encoded in the tracker and said image.

2. The method for boresighting of a designation system as recited in claim 1, wherein said beam of light is a laser beam.

3. The method for boresighting of a designation system as recited in claim 2, further comprising the step of:

(d) displaying simultaneously, on a video monitor, said image along with the indicator.

4. The method for boresighting of a designation system as recited in claim 3, wherein said determining is effected by steps including:

(i) integrating said image and background light together in a first memory bank; and (ii) integrating only said background light in a second memory bank.

5. The method for boresighting of a designation system as recited in claim 3, wherein said indicator is displayed on said video monitor as a cross-hair.

6. The method of claim 1, wherein said target is a diffuse body.

* * * * *